US010741165B2

(12) United States Patent
Torres

(10) Patent No.: US 10,741,165 B2
(45) Date of Patent: Aug. 11, 2020

(54) SYSTEMS AND METHODS FOR NOISE-CANCELLATION WITH SHAPING AND WEIGHTING FILTERS

(71) Applicant: Bose Corporation, Framingham, MA (US)

(72) Inventor: Wade Torres, Attleboro, MA (US)

(73) Assignee: Bose Corporation, Framingham, MA (US)

( * ) Notice: Subject to any disclaimer, the term of this patent is extended or adjusted under 35 U.S.C. 154(b) by 82 days.

(21) Appl. No.: 16/119,468

(22) Filed: Aug. 31, 2018

(65) Prior Publication Data

US 2020/0074975 A1 Mar. 5, 2020

(51) Int. Cl.
*G10K 11/178* (2006.01)

(52) U.S. Cl.
CPC .. *G10K 11/17853* (2018.01); *G10K 11/17825* (2018.01); *G10K 11/17875* (2018.01); *G10K 2210/1282* (2013.01); *G10K 2210/3011* (2013.01); *G10K 2210/3026* (2013.01);
(Continued)

(58) Field of Classification Search
USPC ..... 381/13, 71.1, 71.4, 73.1, 94.1, 317
See application file for complete search history.

(56) References Cited

U.S. PATENT DOCUMENTS

| | | | |
|---|---|---|---|
| 7,340,064 | B2 | 3/2008 | Onishi et al. |
| 7,885,417 | B2 | 2/2011 | Christoph |
| 8,077,873 | B2 | 12/2011 | Shridhar et al. |

(Continued)

FOREIGN PATENT DOCUMENTS

| | | |
|---|---|---|
| CN | 104952442 | 9/2015 |
| EP | 0721179 | 7/1996 |

(Continued)

OTHER PUBLICATIONS

International Search Report and the Written Opinion of the International Searching Authority, International Application No. PCT/US2019/048869, pp. 1-14, dated Dec. 2, 2019.

(Continued)

*Primary Examiner* — Yosef K Laekemariam
(74) *Attorney, Agent, or Firm* — Bond, Schoeneck & King, PLLC

(57) ABSTRACT

A noise-cancellation system, including: a noise-cancellation filter configured to generate a noise-cancellation signal; an actuator configured to receive the noise-cancellation signal and to transduce a noise-cancellation audio signal based on the noise-cancellation signal, the noise-cancellation audio signal destructively interfering with an undesired noise in a noise-cancellation zone in a predefined volume; an error sensor configured to output an error sensor signal, the error sensor signal being representative of residual undesired noise in the noise-cancellation zone; a performance cost filter configured to receive and filter the error sensor signal and to output a performance cost filter signal, the performance cost filter signal being representative of the error sensor signal as weighted by a performance cost function; and an adjustment module configured to receive the performance cost filter signal and to adjust the noise-cancellation filter such that the noise-cancellation audio signal minimizes the performance cost filter signal.

20 Claims, 3 Drawing Sheets

(52) U.S. Cl.
CPC ..... *G10K 2210/3027* (2013.01); *G10K 2210/3028* (2013.01)

(56) References Cited

U.S. PATENT DOCUMENTS

| | | | | |
|---|---|---|---|---|
| 8,135,140 | B2 | 3/2012 | Shridhar et al. | |
| 8,189,799 | B2 | 5/2012 | Shridhar et al. | |
| 8,199,923 | B2 | 6/2012 | Christoph | |
| 8,199,924 | B2 | 6/2012 | Wertz et al. | |
| 8,270,626 | B2 | 9/2012 | Shridhar et al. | |
| 8,315,404 | B2 | 11/2012 | Shridhar et al. | |
| 8,559,648 | B2 | 10/2013 | Christoph | |
| 8,565,443 | B2 | 10/2013 | Wurm | |
| 8,644,521 | B2 | 2/2014 | Christoph et al. | |
| 8,718,289 | B2 | 5/2014 | Shridhar et al. | |
| 8,848,937 | B2 | 9/2014 | Inoue et al. | |
| 9,020,158 | B2 | 4/2015 | Wertz et al. | |
| 9,042,569 | B2 | 5/2015 | Sakamoto et al. | |
| 9,153,226 | B2 | 10/2015 | Wurm | |
| 9,431,001 | B2 | 8/2016 | Cherkassky et al. | |
| 9,445,192 | B2 | 9/2016 | Ueno et al. | |
| 9,478,209 | B2 | 10/2016 | Wurm | |
| 9,595,253 | B2 | 3/2017 | Inoue | |
| 9,596,540 | B2 | 3/2017 | Tani et al. | |
| 9,626,954 | B2 | 4/2017 | Yano | |
| 9,646,596 | B2 | 5/2017 | Tani et al. | |
| 9,870,763 | B1 | 1/2018 | Christian | |
| 2013/0191119 | A1* | 7/2013 | Sugiyama | H04B 3/23 704/226 |
| 2014/0369511 | A1* | 12/2014 | Sheerin | H04R 29/004 381/58 |
| 2016/0314778 | A1 | 10/2016 | Christoph et al. | |
| 2017/0076711 | A1 | 3/2017 | Christoph et al. | |
| 2017/0076712 | A1 | 3/2017 | Christoph | |
| 2017/0110108 | A1 | 4/2017 | Christoph et al. | |
| 2017/0178617 | A1 | 6/2017 | Christoph et al. | |
| 2017/0330551 | A1 | 11/2017 | Zafeiropoulos | |

FOREIGN PATENT DOCUMENTS

| | | |
|---|---|---|
| EP | 0898266 | 2/1999 |
| EP | 1414021 | 5/2008 |
| EP | 2375408 | 10/2011 |
| EP | 2996111 | 3/2016 |
| EP | 3147896 | 3/2017 |
| EP | 3156998 | 4/2017 |
| EP | 3157000 | 4/2017 |
| EP | 3157001 | 4/2017 |
| EP | 3159891 | 8/2018 |
| GB | 2257327 | 1/1993 |

OTHER PUBLICATIONS

Roure et al., The Remote Microphone Technique for Active Noise Control, Proceedings of Active 99, Dec. 1999, ISSN 0-9622072-2-5, pp. 1233-1244.

Moreau et al., A Review of Virtual Sensing Algorithms for Active Noise Control, Algorithms, 2008, 1, 69-99; DOI: 10.3390/a1020069, ISSN 1999-4893, pp. 69-99.

Oh et. al., Development of Mass Producible ANC System for Broad-Band Road Noise, SAE Technical Paper 2018-01-1561, Jun. 13, 2018, doi:10.4271/2018-01-1561, pp. 1-5.

* cited by examiner

SYSTEMS AND METHODS FOR NOISE-CANCELLATION WITH SHAPING AND WEIGHTING FILTERS

BACKGROUND

The present disclosure generally relates to systems and methods noise-cancellation using shaping and weighting filters.

SUMMARY

All examples and features mentioned below can be combined in any technically possible way.

In one aspect, a noise-cancellation system, includes: a noise-cancellation filter configured to generate a noise-cancellation signal; an actuator configured to receive the noise-cancellation signal and to transduce a noise-cancellation audio signal based on the noise-cancellation signal, the noise-cancellation audio signal destructively interfering with an undesired noise in a noise-cancellation zone in a predefined volume; an error sensor configured to output an error sensor signal, the error sensor signal being representative of residual undesired noise in the noise-cancellation zone; a performance cost filter configured to receive and filter the error sensor signal and to output a performance cost filter signal, the performance cost filter signal being representative of the error sensor signal as weighted by a performance cost function; and an adjustment module configured to receive the performance cost filter signal and to adjust the noise-cancellation filter such that the noise-cancellation audio signal minimizes the performance cost filter signal.

In various examples, the noise-cancellation system further includes: an actuator effort cost filter configured to receive and to filter the noise-cancellation signal and to output an actuator effort cost filter signal, the actuator effort cost filter signal being representative of the noise-cancellation signal as weighted by an actuator effort cost function, wherein the adjustment module is further configured to receive the actuator effort cost filter signal and to adjust the noise-cancellation filter such that the noise-cancellation audio signal minimizes the actuator effort cost filter signal.

In an embodiment, the error sensor may be a microphone.

In an embodiment, the actuator may be a speaker.

In an embodiment, the performance cost function may be configured to increase the destructive interference of a predetermined a frequency.

In an embodiment, the performance cost function may be configured to increase the destructive interference in the noise-cancellation zone and to decrease the destructive interference in a second noise-cancellation zone.

In an embodiment, the actuator effort cost function may be configured to penalize actuator effort within a range of frequencies.

In an embodiment, wherein the actuator effort cost function may be configured to penalize actuator effort below a first frequency and above a second frequency, wherein the second frequency is higher than the first frequency.

In another aspect, a noise-cancellation system, includes: a noise-cancellation filter configured to generate a noise-cancellation signal; an actuator configured to receive the noise-cancellation signal and to transduce a noise-cancellation audio signal based on the noise-cancellation signal, the noise-cancellation signal destructively interfering with an undesired noise signal in a noise-cancellation zone; an error sensor configured to output an error sensor signal, the error sensor signal being representative of residual undesired noise in the noise-cancellation zone; an actuator effort cost filter configured to receive and to filter the noise-cancellation signal and to output an actuator effort cost filter signal, the actuator effort cost filter signal being representative of the noise-cancellation as weighted by an actuator effort cost function; an adjustment module configured to receive the actuator effort cost filter signal and to adjust the noise-cancellation filter such that the noise-cancellation audio signal minimizes the actuator effort cost filter signal.

In an embodiment, the error sensor may be a microphone.

In an embodiment, the actuator may be a speaker.

In an embodiment, the actuator effort cost function is configured to penalize actuator effort within a range of frequencies.

In an embodiment, the actuator effort cost function is configured to penalize actuator effort below a first frequency and above a second frequency, wherein the second frequency is higher than the first frequency.

In another aspect, a noise-cancellation method, includes: generating, with a noise-cancellation filter, a noise-cancellation signal; providing the noise-cancellation signal to an actuator for transduction of a noise-cancellation audio signal based on the noise-cancellation signal, the noise-cancellation signal destructively interfering with an undesired noise signal in a noise-cancellation zone; receiving an error sensor signal from an error sensor, the error sensor signal being representative of residual undesired noise in the noise-cancellation zone; filtering the error sensor signal with a performance cost filter to output a performance cost filter signal, the performance cost filter signal being representative of the error sensor signal as weighted by a performance cost function; and adjusting the noise-cancellation filter based on the performance cost filter signal, such that the noise-cancellation audio signal minimizes the performance cost filter signal.

In various examples, the noise-cancellation method may further include the steps of filtering the noise-cancellation signal with an actuator effort cost filter configured to output an actuator effort cost filter signal, the actuator effort cost filter signal being representative of the noise-cancellation signal as weighted by an actuator effort cost function, and adjusting the noise-cancellation filter based on the actuator effort cost filter signal, such that the noise-cancellation audio signal minimizes the actuator effort cost filter signal.

In an embodiment, the error sensor may be a microphone.

In an embodiment, the actuator may be a speaker.

In an embodiment, the performance cost function may be configured to increase the destructive interference of a predetermined a frequency.

In an embodiment, the performance cost function may be configured to increase the destructive interference in the noise-cancellation zone and to decrease the destructive interference in a second noise-cancellation zone.

In an embodiment, the actuator effort cost function is configured to penalize actuator effort within a range of frequencies.

In an embodiment, the actuator effort cost function is configured to penalize actuator effort below a first frequency and above a second frequency, wherein the second frequency is higher than the first frequency.

The details of one or more implementations are set forth in the accompanying drawings and the description below. Other features, objects, and advantages will be apparent from the description and the drawings, and from the claims.

DETAILED DESCRIPTION

Noise-cancellation systems that cancel noise in predefined volume, such as a vehicle cabin, often employ an error sensor to generate an error signal representative of residual uncancelled noise. This error signal is fed back to an adaptive filter that adjusts the noise-cancellation signal such that the residual uncancelled noise is minimized. These noise-cancellation systems, however, offer limited ability to control the error signal itself and thus are ill-suited to allow additional tailoring of the noise-cancellation.

Various embodiments disclosed herein are directed to a noise-cancellation system that permits the weighting of the error signal with a performance cost filter, providing greater control and configurability of the noise-cancellation.

Figure 1:
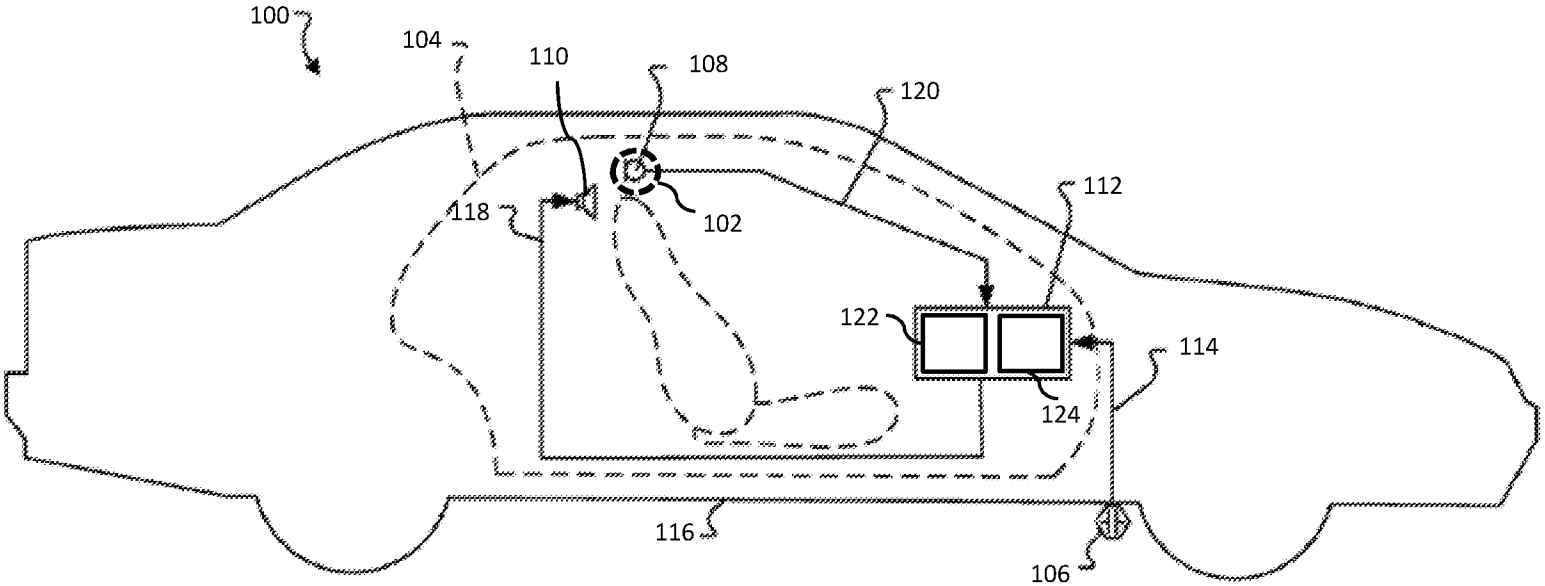
FIG. 1 is a schematic of a noise-cancellation system according to an embodiment.

FIG. 1 is a schematic view of noise-cancellation system 100 that provides greater configurability by employing a performance cost filter and an actuator effort cost filter. Noise-cancellation system 100 is configured to destructively interfere with undesired sound in at least one cancellation zone 102 within a predefined volume 104 such as a vehicle cabin. At a high level, an embodiment of noise-cancellation system 100 may include a noise sensor 106, an error sensor 108, an actuator 110, and a controller 112.

In an embodiment, noise sensor 106 is configured to generate noise signal(s) 114 representative of the undesired sound, or a source of the undesired sound, within predefined volume 104. For example, as shown in FIG. 1, noise sensor 106 may be an accelerometer mounted to and configured to detect vibrations transmitted through a vehicle structure 116. Vibrations transmitted through the vehicle structure 116 are transduced by the structure into undesired sound in the vehicle cabin (perceived as a road noise), thus an accelerometer mounted to the structure provides a signal representative of the undesired sound Actuator 110 may, for example, be speakers distributed in discrete locations about the perimeter of the predefined volume. In an example, four or more speakers may be disposed within a vehicle cabin, each of the four speakers being located within a respective door of the vehicle and configured project sound into the vehicle cabin. In alternate embodiments, speakers may be located within a headrest, or elsewhere in the vehicle cabin.

A noise-cancellation signal 118 may be generated by controller 112 and provided to one or more speakers in the predefined volume, which transduce the noise-cancellation signal 118 to acoustic energy (i.e., sound waves). The acoustic energy produced as a result of noise-cancellation signal 118 is approximately 180° out of phase with—and thus destructively interferes with—the undesired sound within the cancellation zone 102. The combination of sound waves generated from the noise-cancellation signal 118 and the undesired noise in the predefined volume results in cancellation of the undesired noise, as perceived by a listener in a cancellation zone.

Because noise-cancellation cannot be equal throughout the entire predefined volume, noise-cancellation system 100 is configured to create the greatest noise cancellation within one or more predefined cancellation zones 102 with the predefined volume. The noise-cancellation within the cancellation zones may effect a reduction in undesired sound by approximately 3 dB or more (although in varying embodiments, different amounts of noise-cancellation may occur). Furthermore, the noise-cancellation may cancel sounds in a range of frequencies, such as frequencies less than approximately 350 Hz (although other ranges are possible).

Error sensor 108, disposed within the predefined volume, generates an error sensor signal 120 based on detection of residual noise resulting from the combination of the sound waves generated from the noise-cancellation signal 118 and the undesired sound in the cancellation zone. The error sensor signal 120 is provided to controller 112 as feedback, error sensor signal 120 representing residual noise, uncancelled by the noise-cancellation signal. Error sensors 108 may be, for example, at least one microphone mounted within a vehicle cabin (e.g., in the roof, headrests, pillars, or elsewhere within the cabin).

It should be noted that the cancellation zone(s) may be positioned remotely from error sensor 108. In this case, the error sensor signal 120 may be filtered to represent an estimate of the residual noise in the cancellation zone(s). In either case, the error signal will be understood to represent residual undesired noise in the cancellation zone.

In an embodiment, controller 112 may comprise a non-transitory storage medium 122 and processor 124. In an embodiment, non-transitory storage medium 122 may store program code that, when executed by processor 124, implements the various filters and algorithms described in connection with FIGS. 2-3. Controller 112 may be implemented in hardware and/or software. For example, controller may be implemented by an FPGA, an ASIC, or other suitable hardware.

Figure 2:
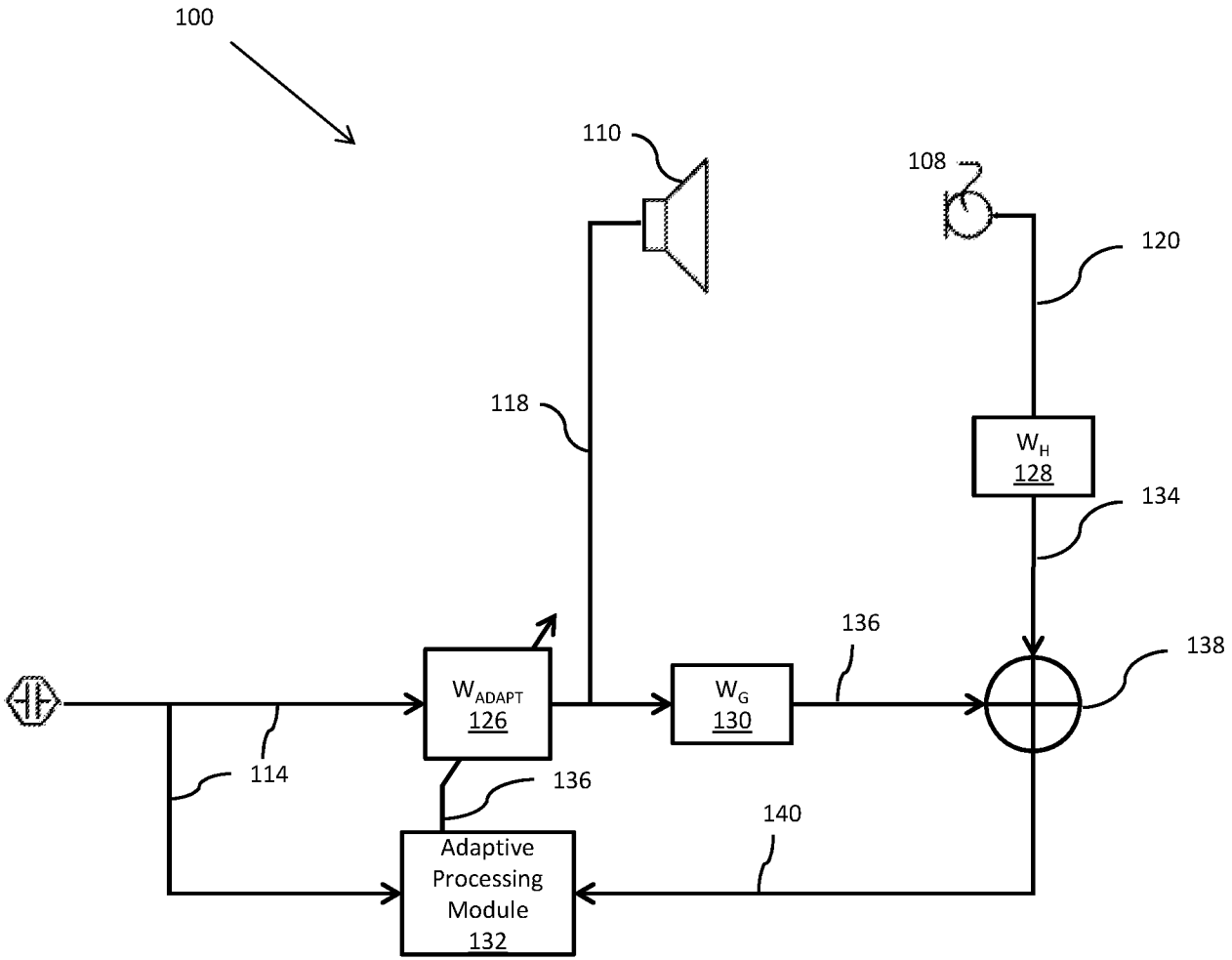
FIG. 2 is a schematic of a noise-cancellation system according to an embodiment.

Turning to FIG. 2, there is shown a block diagram of an embodiment of noise-cancellation system 100, including a plurality of filters implemented by controller 112. As shown, controller may define a control system including Wadapt filter 126, performance cost $W_H$ filter 128, actuator effort $W_G$ filter 130, and an adaptive processing module 132.

Wadapt filter 126 is configured to receive the noise signal 114 of noise sensor 106 and to generate noise-cancellation signal 118. Noise-cancellation signal 118, as described above, is input to actuator 110 where it is transduced into the noise-cancellation audio signal that destructively interferes with the undesired sound in the predefined cancellation zone 102. Wadapt filter 126 may be implemented as any suitable linear filter, such as a multi-input multi-output (MIMO) finite impulse response (FIR) filter.

Adaptive processing module 132 receives as inputs the error sensor signal 134 (filtered by performance cost $W_H$ filter 128 and summed with the output of actuator effort cost $W_G$ filter, as will be described below) and the noise signal 114 and, using those inputs, generates a filter update signal 136. The filter update signal 136 is an update to the filter coefficients implemented in filter $W_{adapt}$. The noise-cancellation signal 118 produced by the updated Wadapt filter 126 will minimize signal 140.

As will be described in detail below, performance cost $W_H$ filter 128 and actuator effort cost $W_G$ filter 130 function to add a performance cost function and an actuator effort cost function, respectively, to the signal input to adaptive processing module 132. The cost functions introduced by these filters are minimized by adaptive processing module 132, and thus, by configuring performance cost $W_H$ filter 128 and actuator effort cost $W_G$ filter 130 the signal minimized by adaptive processing module 132, and thus noise-cancellation itself, may be tailored. Accordingly, performance cost $W_H$ filter 128 and actuator effort cost $W_G$ filter provide a greater degree of control with respect to the noise-cancellation. Each performance cost $W_H$ filter 128 and actuator effort cost $W_G$ filter may be implemented as a linear filter, such as a multiple-input, multiple-output finite-impulse response filter, although other kinds of linear filters may be used.

More specifically, as shown in FIG. 2, performance cost $W_H$ filter 128 weights the error sensor signal 120 with a performance cost function H (the weighted error sensor signal 120 is outputted as performance cost filter signal 134). This performance cost $W_H$ filter 128 effectively defines an arbitrary cost function H that permits configurable weighting of noise-cancellation occurring within cancellation zone 102, as a function of frequency. In the case of multiple noise cancellation zones 102, each zone may be individually configured as a function of frequency (e.g., one cancellation zone may have increased noise-cancellation and the other may have decreased noise cancellation). For example, in a vehicle context, performance cost $W_H$ filter 128 permits weighting a particular passengers ears more heavily (i.e, to increase noise cancellation in one noise-cancellation zone over another) or focus on a particular frequency (e.g., increasing the noise cancellation of 100 Hz over 200 Hz).

For reasons described in detail below, in order to minimize the performance cost function H, the performance cost $W_H$ filter 128 may convolve the performance cost function H with the conjugate transpose of the performance cost function H' (and thus error sensor signal 120 may be weighted with both the performance cost function H and the conjugate transpose of the performance cost function H'). Indeed, the performance cost $W_H$ filter 128 may implement equation (14) defined below.

Actuator effort cost $W_G$ filter 130 weights the noise-cancellation signal 118 with actuator effort cost function G (the weighted noise-cancellation signal 118 is outputted as actuator effort cost filter signal 136). The actuator effort cost $W_G$ filter 130 effectively penalizes actuator effort with actuator effort cost function G. This prevents, for example, noise-cancellation signal 118 from growing unbounded in response to a given undesired noise and overdriving actuator 110. Furthermore, actuator effort cost function G may penalize actuator effort according to frequency. For example, actuator effort may be penalized under 20 Hz (below the range of a passenger's hearing) and above 350 Hz. Actuator effort cost function may thus define a passband filter for the actuator output.

For reasons described in detail below, in order to minimize the performance cost function G, the actuator effort cost $W_G$ filter 130 may convolve the actuator effort cost function G with the conjugate transpose of the actuator effort cost function G' (and thus noise-cancellation signal 118 may be weighted with both the actuator effort cost function G and the conjugate transpose of the actuator effort cost function G'). Indeed, the actuator effort cost $W_G$ filter 130 may implement equation (15) defined below.

Generally, the adaptive processing module 132 is configured to minimize a cost function, J, defined by the following equation:

$$J = \frac{1}{2}e^T e = \frac{1}{2}\sum_i e_i^2 \tag{1}$$

where $$e = \begin{bmatrix} e_1 \\ e_2 \\ \vdots \\ e_n \end{bmatrix} \tag{2}$$

and $e_i$ represents the $i^{th}$ error sensor signal from an error sensor 108 positioned at a user's ears or elsewhere. Equation (1) may be expanded into terms that include $W_{adapt}$ as follows:

$$J=\tfrac{1}{2}(\eta_{ear}-T_{de}*W_{adapt}*x)^T(\eta_{ear}-T_{de}*W_{adapt}*x) \tag{3}$$

where $\eta_{ear}$ is the undesired noise within a cancellation zone 102, $T_{de}$ is the physical transfer function between actuator 110 and the cancellation zone 102 (typically, because the cancellation zone is collocated with the error sensor 108, $T_{de}$ may represent the physical transfer function between actuator 110 and the cancellation zone), and x is the output signal of the noise sensor 106.

Now that the cost function is expressed in terms of $W_{adapt}$, the derivative of the cost function may be taken with respect to $W_{adapt}$, and $W_{adapt}$ may be updated such that it steps in a direction that reduces the cost function J. In other words, the update filter steps in the direction of $$-\frac{\partial J}{\partial W}.$$

The update equation of $W_{adapt}$ thus becomes:

$$W_{adapt}[n+1] = W_{adapt}[n] + u(\tilde{T}'_{de} * e)\frac{x}{\|x\|_2} \tag{4}$$

where $\tilde{T}_{de}$ (this may be implemented as an FIR filter) is an estimate of $T_{de}$, and $\tilde{T}'_{de}$ is the conjugate transpose of $\tilde{T}_{de}$.

The error sensor signals can be filtered with a linear, time-invariant (LTI) MIMO filter, H, in which case the cost function becomes:

$$J=\tfrac{1}{2}(H*e)^T(H*e) \tag{5}$$

which may be rewritten as:

$$=\tfrac{1}{2}(H*\eta_{ear}-H*T_{de}*W_{adapt}*x)^T(H*\eta_{ear}-H*T_{de}*W_{adapt}*x) \tag{6}$$

Choosing $G_{de}=H*T_{de}$, $\hat{e}=H*e$, and $\zeta=H*\eta_{ear}$, equation (6) becomes:

$$J=\tfrac{1}{2}(\zeta-G_{de}*W_{adapt}*x)^T(\zeta-G_{de}*W_{adapt}*x) \tag{7}$$

This is the same form as the original cost function, equation (3), so the update equation including the cost function H becomes:

$$W_{adapt}[n+1] = W_{adapt}[n] + u(G'_{de} * \hat{e})\frac{x}{\|x\|_2} \tag{8}$$

where $G'_{de}$ is the conjugate transpose of $G_{de}$. In terms of the original variables, the update equation becomes $$W_{adapt}[n+1] = W_{adapt}[n] + u(\tilde{T}'_{de} * H' * H * e)\frac{x}{\|x\|_2} \tag{9}$$

where H' is the conjugate transpose of H, and μ is a configurable step size that determines how quickly the update equation converges.

Similarly, defining the cost function to include the actuator effort weighting filter, G (which is also a LTI MIMO filter), as follows:

$$J=\tfrac{1}{2}(G*u)^T(G*u) \tag{10}$$

where u is the noise-cancellation signal 118 sent to actuator 110. Equation (10) may be rewritten as:

$$=\tfrac{1}{2}(G*W_{adapt}*x)^T(G*W_{adapt}*x) \tag{11}$$

Following the pattern of the above equations (5-9), this yields the following update equation:

$$W_{adapt}[n+1] = W_{adapt}[n] + u(G' * G * u)\frac{x}{\|x\|_2} \tag{12}$$

Adding together equation (9) and (12) yields the following update equation:

$$W_{adapt}[n+1] = W_{adapt}[n] + (\mu_1 T'_{de} * H' * H * e + \mu_2 G' * G * u)\frac{x}{\|x\|_2} \tag{13}$$

where $\mu_1$ and $\mu_2$ are each configurable step sizes that may determine how quickly the update equation (13) converges.

In view of equation (13), the performance cost $W_H$ filter 128 may thus be defined as:

$$\mu_1 \tilde{T}'_{de} * H' * H \tag{14}$$

And the actuator effort cost $W_G$ filter 130 may be defined as:

$$\mu_2 G' * G * u \tag{15}$$

As defined, the performance cost filter $W_H$ convolves the performance cost function H with the conjugate transpose of the performance cost filter H', and the actuator effort cost filter $W_G$ convolves the actuator effort cost function G with the conjugate transpose of the actuator effort cost function G', in order to minimize the respective cost functions.

As shown in FIG. 2, the performance cost filter signal 134 and the actuator effort cost filter signal 136 may be summed at summing block 138. The output 140 of the summing block 138 the error sensor 120 and the noise-cancellation signal 118 as weighted with the performance cost function H and actuator effort cost function G, respectively. The output 140 is input to adaptive processing module 132, where coefficients of adaptive filter Wadapt 126 are adjusted such that the noise-cancellation signal 118 and, consequently, the noise-cancellation audio signal minimizes the performance cost filter signal 134 and the actuator effort cost filter signal 136, as described at least in connection with equations (1-15) above.

It should be understood that noise-cancellation system may include either or both of performance cost $W_H$ filter 128 and actuator effort cost $W_G$ filter 130.

Furthermore, it should be understood that noise-cancellation system 100 may be a single-input/single-output control system or a multi-input/multi-output control system. Noise-cancellation system 100 may include any number of noise sensors 106, error sensors 108, actuators 110, and cancellation zones 102. For example, noise-cancellation system may be extended to include a performance cost $W_H$ filter 128 for each error sensor 108.

Furthermore, it should be understood that the noise-cancellation system 100 depicted in FIG. 2 is merely provided as an embodiment of a control system. Indeed, the control system may be any suitable adaptive control system (feedforward or feedback) that can include either performance cost $W_H$ filter 128 and actuator effort cost $W_G$ filter 130 or both.

The cost functions H and G may be configured during a configuration period (e.g., during manufacture) or may be set by a user either through preconfiguring prior to usage or on-the-fly while the noise-cancellation system is in use. In either instance, the cost functions H and G may be set using, for example, a user interface.

Figure 3:
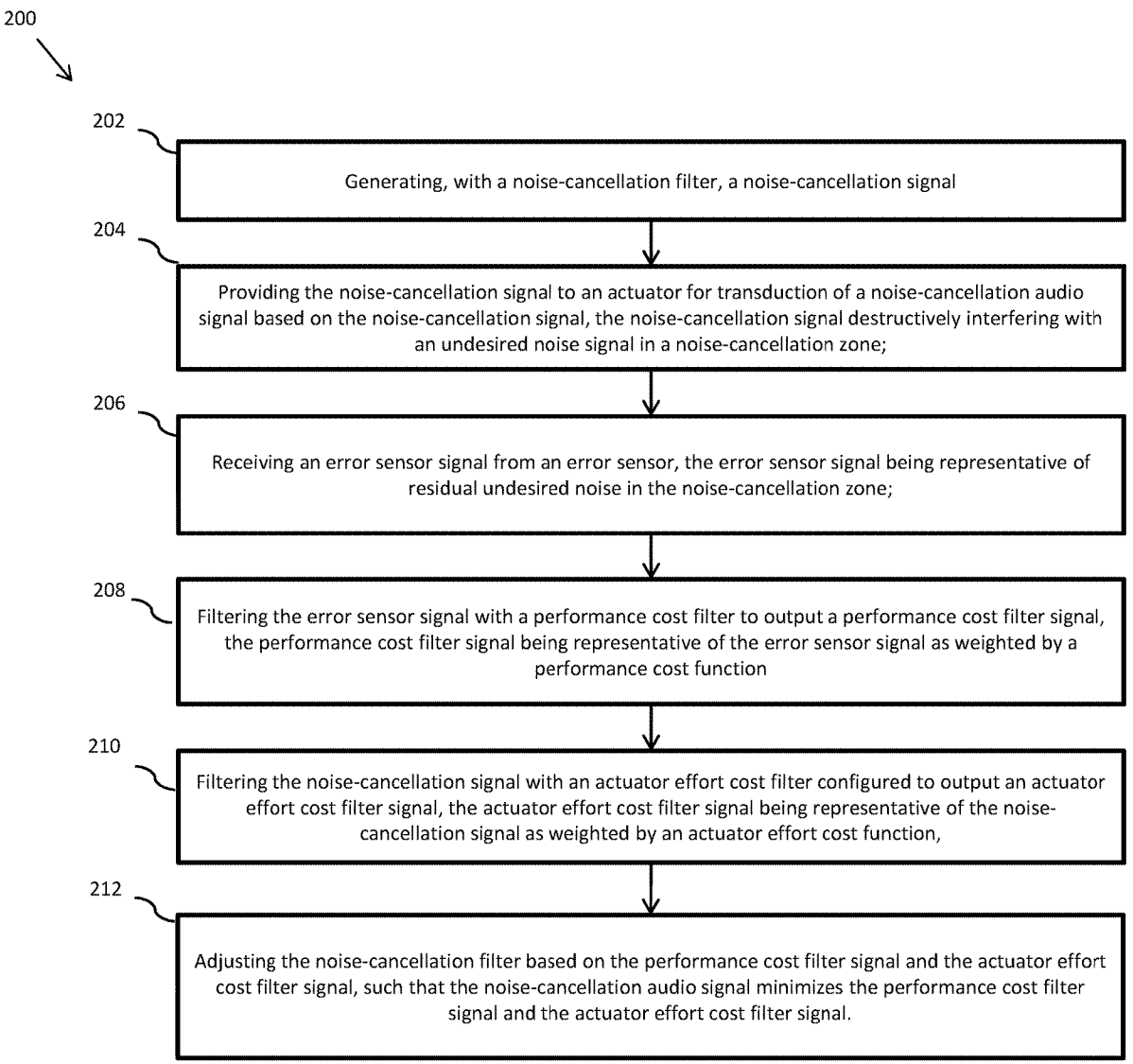
FIG. 3 is a flowchart of a noise-cancellation method according to an embodiment.

FIG. 3 depicts of a flowchart of a noise-cancellation method that can implement and minimize a performance cost function and an actuator effort cost function. Method 200 may be implemented with a control system, such as noise-cancellation system 100 described in connection with FIGS. 1-2, however it should be understood that any other suitable control system including performance cost and/or actuator effort cost weighting filters may be used.

At step 202, a noise-cancellation signal is generated with a noise-cancellation filter. The noise-cancellation signal may be generated using an adaptive filter such as Wadapt filter 126, however it should be understood that any suitable adaptive filter (feedforward or feedback) that can be used in connection with performance cost and/or actuator effort cost weighting filters may be used.

At step 204, providing the noise-cancellation signal to an actuator for transduction of a noise-cancellation audio signal based on the noise-cancellation signal, the noise-cancellation signal destructively interfering with an undesired noise signal in a noise-cancellation zone.

At step 206, an error sensor signal is received from an error sensor, the error sensor signal being representative of residual undesired noise in the noise-cancellation zone. The error sensor signal may be received from an error sensor such as error sensor 108. It should be understood that error sensor signal may be a filtered error sensor signal that predicts the residual noise at a cancellation zone remote from the error sensor. In either case, the error sensor signal is representative of residual undesired noise in the noise-cancellation zone.

At step 208, error sensor signal is filtered with a performance cost filter to output a performance cost filter signal, the performance cost filter signal being representative of the error sensor signal as weighted by a performance cost function. This performance cost filter effectively defines an arbitrary cost function H that permits configurable weighting of noise-cancellation occurring within cancellation zone, as a function of frequency. In the case of multiple noise cancellation zones, each zone may be individually configured as a function of frequency (e.g., one cancellation zone may have increased noise-cancellation and the other may have decreased noise cancellation). For example, in a vehicle context, performance cost filter permits weighting a particular passengers ears more heavily (i.e, to increase noise cancellation in one noise-cancellation zone over another) or focus on a particular frequency (e.g., increasing the noise cancellation of 100 Hz over 200 Hz).

As part of this step, in order to minimize the performance cost function H, the performance cost filter may convolve the performance cost function H with the conjugate transpose of the performance cost function H' (and thus error sensor signal may be weighted with both the performance cost function H and the conjugate transpose of the performance cost function). Indeed, the performance cost filter may implement equation (14) defined above.

At step 210, noise-cancellation signal is filtered with an actuator effort cost filter configured to output an actuator effort cost filter signal, the actuator effort cost filter signal being representative of the noise-cancellation signal as weighted by an actuator effort cost function. The actuator effort cost filter effectively penalizes actuator effort with actuator effort cost function G. This prevents, for example, noise-cancellation signal 118 from growing unbounded in response to a given undesired noise and overdriving actuator 110. Furthermore, actuator effort cost function G may penalize actuator effort according to frequency. For example, actuator effort may be penalized under 20 Hz (below the range of a passenger's hearing) and above 350 Hz. Actuator effort cost function may thus define a passband filter for the actuator output.

As part of this step, in order to minimize the performance cost function G, the actuator effort cost filter may convolve the actuator effort cost function G with the conjugate transpose of the actuator effort cost function G' (and thus noise-cancellation signal may be weighted with both the actuator effort cost function G and the conjugate transpose of the actuator effort cost function G'). Indeed, the actuator effort cost filter may implement equation (15) defined above.

At step 212, noise-cancellation filter is adjusted based on the performance cost filter signal and the actuator effort cost filter signal, such that the noise-cancellation audio signal minimizes the performance cost filter signal and the actuator effort cost filter signal. For example, the first predictive filter output signal and the second predictive filter output signal may be fed to an adaptive algorithm, which updates the coefficients of the adaptive filter, such that the adaptive filter generates a noise-cancellation signal based on the signals weighted with the performance cost functions and the actuator effort cost functions, in order to minimize both.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A noise-cancellation system, comprising:

a noise-cancellation filter generating a noise-cancellation signal;

an actuator receiving the noise-cancellation signal and transducing a noise-cancellation audio signal based on the noise-cancellation signal, the noise-cancellation audio signal interfering with an undesired noise in a noise-cancellation zone in a predefined volume;

an error sensor outputting an error sensor signal, the error sensor signal being representative of residual undesired noise in the noise-cancellation zone;

a performance cost filter receiving and filtering the error sensor signal and outputting a performance cost filter signal, the performance cost filter signal being representative of the error sensor signal as weighted by a performance cost function; and an adjustment module receiving the performance cost filter signal and adjusting the noise-cancellation filter such that the noise-cancellation audio signal minimizes the performance cost filter signal.

2. The noise-cancellation system of claim 1, further comprising: an actuator effort cost filter receiving and filtering the noise-cancellation signal and outputting an actuator effort cost filter signal, the actuator effort cost filter signal being representative of the noise-cancellation signal as weighted by an actuator effort cost function, wherein the adjustment module further receives the actuator effort cost filter signal and adjusts the noise-cancellation filter such that the noise-cancellation audio signal minimizes the actuator effort cost filter signal.

3. The noise-cancellation system of claim 1, wherein the error sensor is a microphone.

4. The noise-cancellation system of claim 1, wherein the actuator is a speaker.

5. The noise-cancellation system of claim 1, wherein the performance cost function increases the interference of a predetermined a frequency.

6. The noise-cancellation system of claim 1, wherein the performance cost function increases the interference in the noise-cancellation zone and decreases the interference in a second noise-cancellation zone.

7. The noise-cancellation system of claim 2, wherein the actuator effort cost function penalizes actuator effort within a range of frequencies.

8. The noise-cancellation system of claim 7, wherein the actuator effort cost function penalizes actuator effort below a first frequency and above a second frequency, wherein the second frequency is higher than the first frequency.

9. A noise-cancellation system, comprising:

a noise-cancellation filter generating a noise-cancellation signal;

an actuator receiving the noise-cancellation signal and transducing a noise-cancellation audio signal based on the noise-cancellation signal, the noise-cancellation signal interfering with an undesired noise signal in a noise-cancellation zone;

an error sensor outputting an error sensor signal, the error sensor signal being representative of residual undesired noise in the noise-cancellation zone;

an actuator effort cost filter receiving and filtering the noise-cancellation signal and outputting an actuator effort cost filter signal, the actuator effort cost filter signal being representative of the noise-cancellation as weighted by an actuator effort cost function;

an adjustment module receiving the actuator effort cost filter signal and adjusting the noise-cancellation filter such that the noise-cancellation audio signal minimizes the actuator effort cost filter signal.

10. The noise-cancellation system of claim 9, wherein the error sensor is a microphone.

11. The noise-cancellation system of claim 9, wherein the actuator effort cost function penalizes actuator effort within a range of frequencies.

12. The noise-cancellation system of claim 11, wherein the actuator effort cost function penalizes actuator effort below a first frequency and above a second frequency, wherein the second frequency is higher than the first frequency.

13. A noise-cancellation method, comprising;

generating, with a noise-cancellation filter, a noise-cancellation signal;

providing the noise-cancellation signal to an actuator for transduction of a noise-cancellation audio signal based on the noise-cancellation signal, the noise-cancellation signal interfering with an undesired noise signal in a noise-cancellation zone;

receiving an error sensor signal from an error sensor, the error sensor signal being representative of residual undesired noise in the noise-cancellation zone;

filtering the error sensor signal with a performance cost filter to output a performance cost filter signal, the performance cost filter signal being representative of the error sensor signal as weighted by a performance cost function; and adjusting the noise-cancellation filter based on the performance cost filter signal, such that the noise-cancellation audio signal minimizes the performance cost filter signal.

14. The noise-cancellation method of claim 13 further comprising:

filtering the noise-cancellation signal with an actuator effort cost filter that outputs an actuator effort cost filter signal, the actuator effort cost filter signal being representative of the noise-cancellation signal as weighted by an actuator effort cost function, and adjusting the noise-cancellation filter based on the actuator effort cost filter signal, such that the noise-cancellation audio signal minimizes the actuator effort cost filter signal.

15. The noise-cancellation method of claim 13, wherein the error sensor is a microphone.

16. The noise-cancellation method of claim 13, wherein the actuator is a speaker.

17. The noise-cancellation method of claim 13, wherein the performance cost function increases the interference of a predetermined a frequency.

18. The noise-cancellation method of claim 13, wherein the performance cost function increases the interference in the noise-cancellation zone and to decrease the interference in a second noise-cancellation zone.

19. The noise-cancellation method of claim 14, wherein the actuator effort cost function penalizes actuator effort within a range of frequencies.

20. The noise-cancellation method of claim 19, wherein the actuator effort cost function penalizes actuator effort below a first frequency and above a second frequency, wherein the second frequency is higher than the first frequency.

* * * * *